United States Patent [19]

Barlow et al.

[11] 4,148,152

[45] Apr. 10, 1979

[54] CONSTRUCTION TOY WITH REVERSIBLE TRACK HAVING SOUND PRODUCING MEANS

[75] Inventors: Gordon A. Barlow, Evanston; Alex Imatt, Chicago, both of Ill.

[73] Assignee: Marvin Glass & Associates, Chicago, Ill.

[21] Appl. No.: 728,411

[22] Filed: Sep. 30, 1976

Related U.S. Application Data

[62] Division of Ser. No. 659,367, Feb. 19, 1976, abandoned.

[51] Int. Cl.[2] ..... A63H 21/00; A63H 18/02

[52] U.S. Cl. ..... 46/216; 46/17; 46/175 R; 238/10 R

[58] Field of Search ..... 46/16, 17, 12, 13, 175 R, 46/216; 238/10 A, 10 B, 10 C, 10 E, 10 F

[56] References Cited

U.S. PATENT DOCUMENTS

| | | | |
|---|---|---|---|
| 1,242,273 | 10/1917 | Thurman | 46/17 |
| 2,143,195 | 1/1939 | Kahn et al. | 238/10 C |
| 3,013,726 | 12/1961 | Orel | 238/10 E |
| 3,228,607 | 1/1966 | Robinette et al. | 238/10 F |
| 3,548,702 | 12/1970 | Kosuge | 238/10 E X |
| 3,693,289 | 9/1972 | Smith et al. | 46/175 R |
| 3,859,750 | 1/1975 | McKay | 46/43 |

FOREIGN PATENT DOCUMENTS

| | | | |
|---|---|---|---|
| 2223957 | 10/1974 | France | 238/10 F |

*Primary Examiner*—F. Barry Shay

*Attorney, Agent, or Firm*—Mason, Kolehmainen, Rathburn & Wyss

[57] ABSTRACT

A construction toy including a base portion having a grid defined thereon by a plurality of substantially vertical grooves for use in combination with accessory articles. The grooves defined on the grid are arranged to intersect one another at right angles, each pair of which defines a track section over which a suitable vehicle may travel. A plurality of building wall panels are provided for use by positioning in the grooves of the grid to maintain the panels in a generally vertical position to permit combining of the panels to define structures such as houses, trees, or other structures. A plurality of track sections may be connected to the base to provide a path of travel to and away from the base. A connecting device is provided on the end of each track section for connection between adjacent track sections or to the base to secure the assembly as a unitary layout. Each track section is reversible and includes on one side a generally flat surface for traversing by vehicles such as cars and trucks. A pair of tracks are provided on the other side of the track sections for use with vehicles having flanged wheels. Spaced tabs are provided along the tracks to strike the wheel flanges and produce a clicking sound as the vehicle rolls along the track.

5 Claims, 8 Drawing Figures

Fig 2
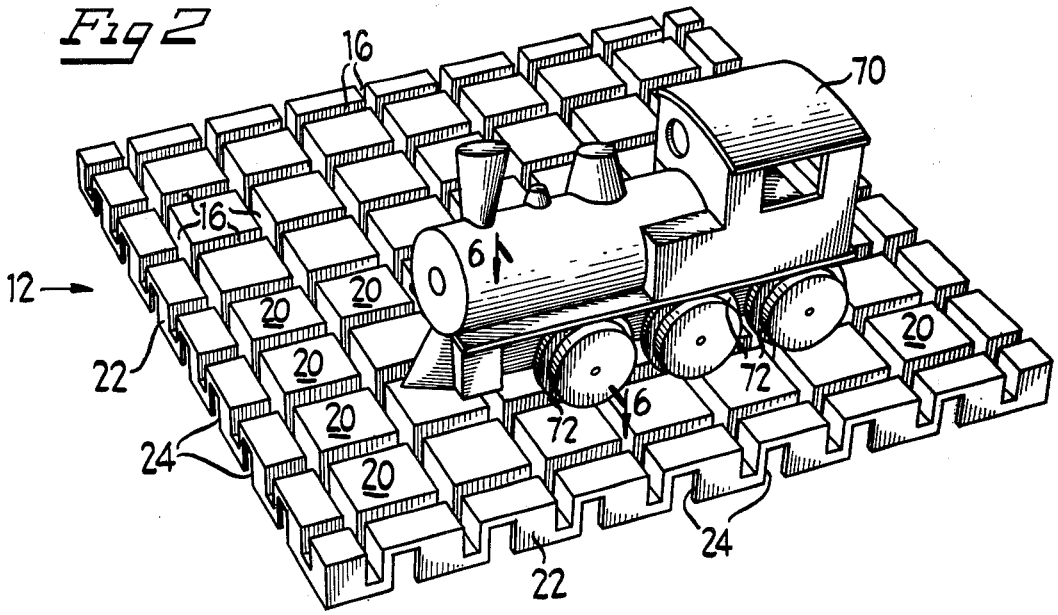
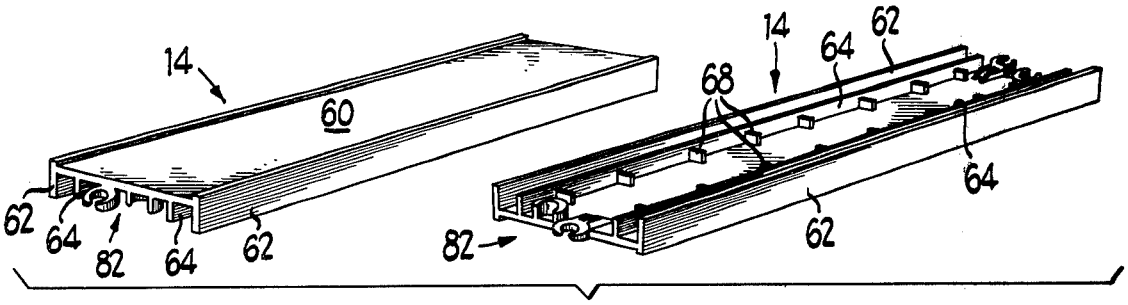
Fig 4
Fig 8
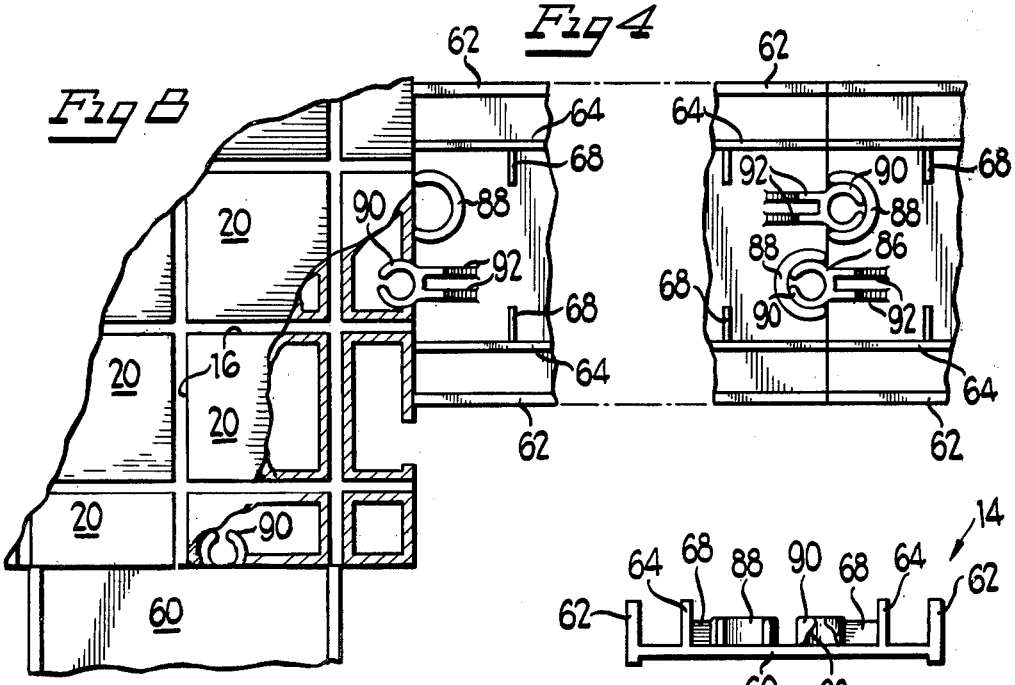
Fig 7

CONSTRUCTION TOY WITH REVERSIBLE TRACK HAVING SOUND PRODUCING MEANS

This is a request for filing a Division of pending prior application Ser. No. 659,333,367 filed on Feb. 19, 1976 now abandoned of GORDON A. BARLOW et al for a CONSTRUCTION TOY.

BACKGROUND OF THE INVENTION

1. Field of the Invention

This invention relates to preschool toys and, particularly, to those which provide various possible combinations of the toy components.

2. Brief Description of the Prior Art

Many preschool construction-type toys have been developed in the past for use by children to aid in the development of their motor skills without limiting their imagination and ingenuity while simultaneously providing enjoyment and pleasure. Some well known toys of this type have included the metal and wooden construction kits and block sets, to name only a few. Other types of construction toys have included model railroad trains and slot car sets which can be constructed in many various patterns or arrangements for use with vehicles. An object of the present invention is to provide a simple, construction-type toy which combines the advantages of many of the above-mentioned items in a single toy.

SUMMARY OF THE INVENTION

In accordance with the above and other objects, the present invention contemplates the provision of a central generally flat base portion having a plurality of grooves therein defining a grid. Various shapes and sizes of building wall panels are described for mounting within the grooves to permit the construction of various buildings or the like. Track portions are provided for use with the grid and include connecting means for securing the track portions to one another and about the periphery of the grid. A model train is provided having wheels which are particularly adapted for running on the track portions and the grid. Each track portion is provided with a flat surface on the side opposite that defining the railroad track for use with conventional toy cars and trucks.

Other objects, features and advantages of the invention will be apparent from the following detailed description taken in connection with the accompanying drawings.

BRIEF DESCRIPTION OF THE DRAWINGS

FIG. 2 is a perspective view of the base showing one of the train vehicles traversing the base;

FIG. 4 is a perspective view of two of the contemplated track portions showing the top and bottom thereof;

FIG. 7 is an end view of one of the track portions showing the connecting means; and FIG. 8 is a fragmented top plan view, on an enlarged scale, showing the cooperation of the track connecting means between the base and connected adjacent track sections.

DESCRIPTION OF THE PREFERRED EMBODIMENT

Figure 1:
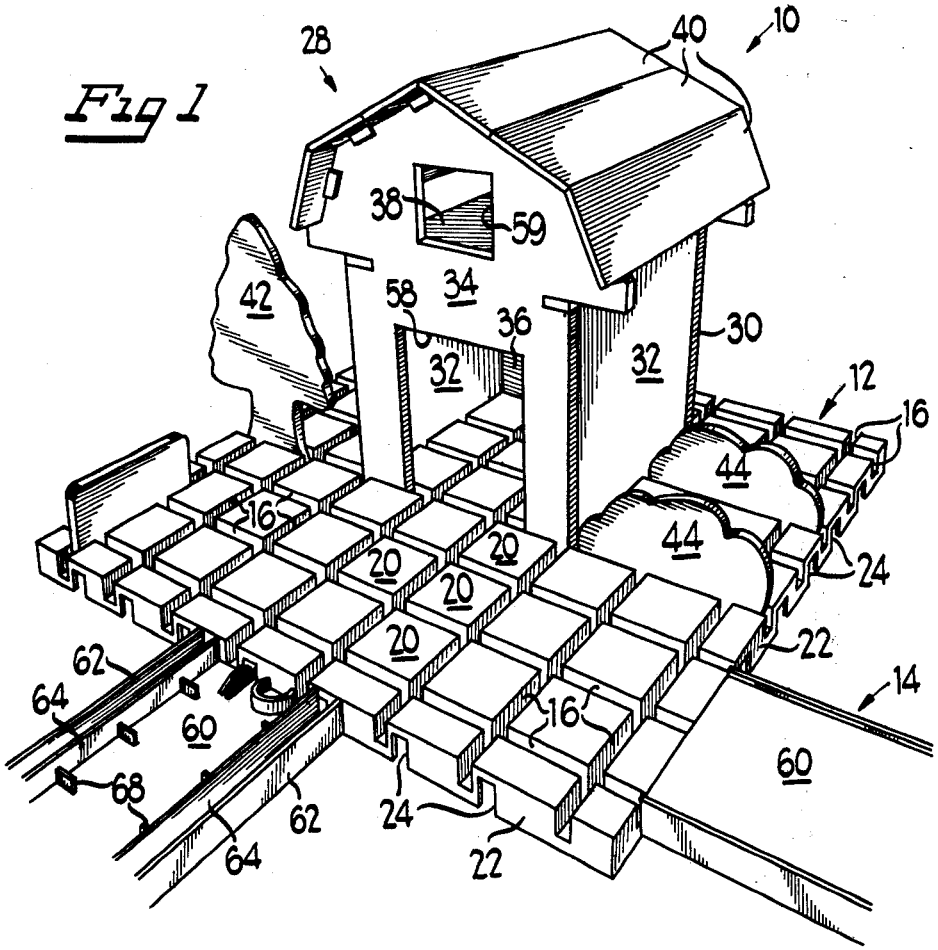
FIG. 1 is a perspective view of a construction-type toy embodying the concepts of the present invention.

The construction toy of the present invention, generally designated 10 (FIG. 1), is shown in a perspective view to include a base portion, generally designated 12, and a plurality of track sections, generally designated 14. The base portion 12 defines a grid having a plurality of generally vertical grooves 16. The grooves 16 are equally spaced from one another and intersect one another at approximately 90° to define the grid. The base 12 may be made by cutting the grooves 16 into a thick plate of solid material, but preferably is unitarily molded so that each of the flat surfaces 20 are relatively hollow on the bottom. This preferred construction will substantially reduce the cost while saving on the amount of material required to produce the base 12. Each of the exterior side walls 22 includes a vertical slot or cutout 24 which facilitates connection with the track sections, as will be described in greater detail hereinafter.

Figure 3:
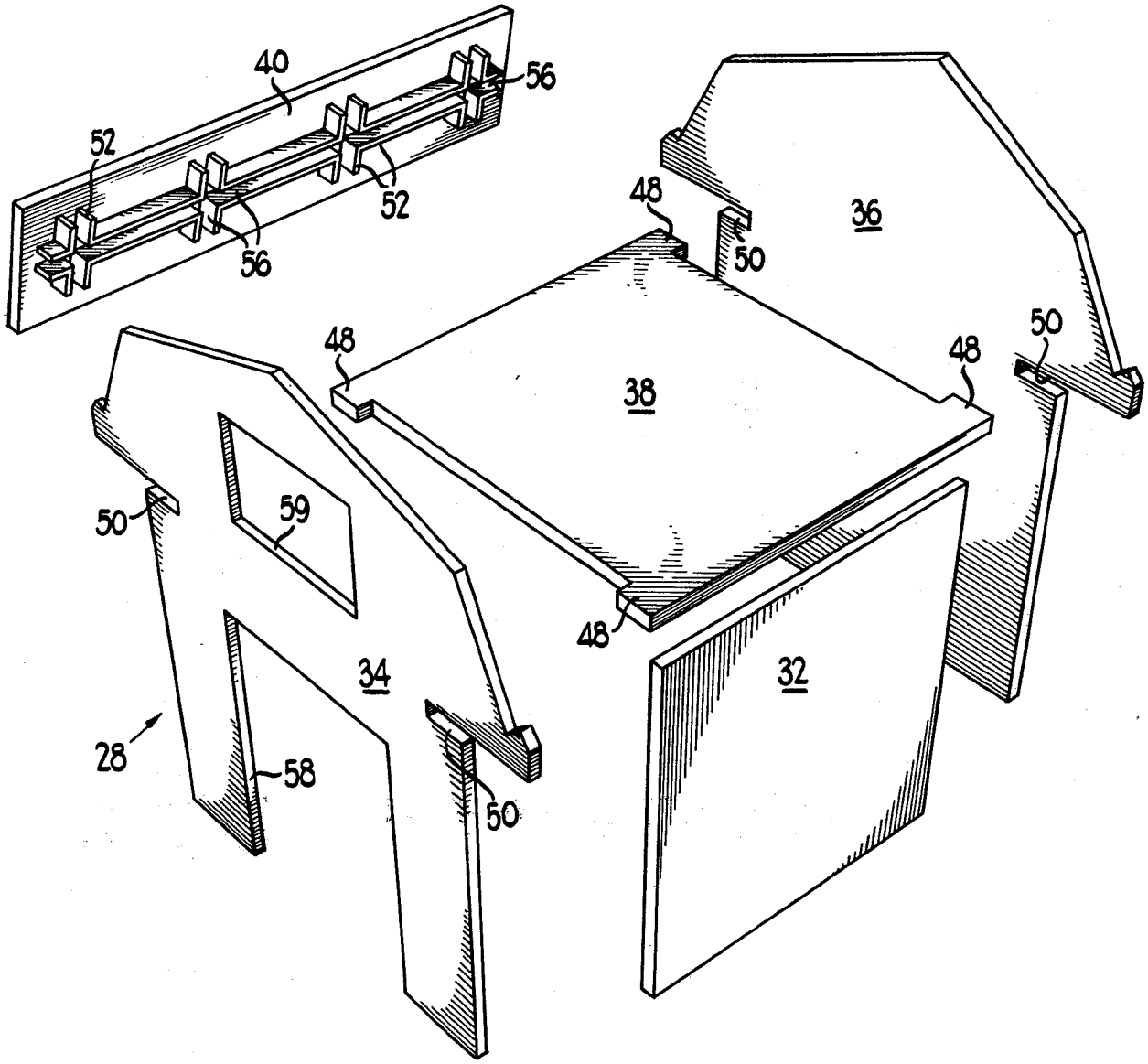
FIG. 3 is an exploded perspective view, on an enlarged scale, of the structure shown on the grid in FIG. 1.

Referring to FIG. 3, a plurality of building wall panels, generally designated 28, are provided for assembly with the base 12 for the construction of various building structures such as the barn 30 of FIG. 1. The barn includes two side walls 32, front and rear walls 34 and 36, respectively, and a horizontal panel 38 which defines the floor of the loft of the barn. A plurality of roof sections 40 mount to the front and rear walls 34 and 36 to define the total roof. In FIG. 1, a plurality of trees 42 and bushes 44 also are shown.

Each of the panels 32, 34, 36, 42 and 44 are made of a suitable material such as cardboard or plastic having a thickness which is substantially identical to the width of the grooves 16. Therefore, the panels may be slidably engaged within any desired groove 16 to be maintained and supported in a generally vertical orientation. The horizontal lengths of all of the building panels 32, 34 and 36 are preferably even multiple combinations of the distance between each of the grooves 16 so that the corners thereof will meet to define a clean seam. For example, the side wall 32 of the barn is approximately equivalent to the distance between three of the grooves, as shown in FIG. 1.

The loft floor includes four tabs 48 which interengage with four appropriately sized slots 50 in the front and rear walls 34 and 36 of the barn. The roof panels 40 include raised flanges 52 which define additional grooves 56 for slidably and frictionally engaging the edges of the front and rear panels 34 and 36 of the barn to maintain the roof on the barn. The grooves 56 provided by the panels 52 are spaced similar to the grooves 16 to match the positioning of the front and rear panels 34 and 36. For realism and additional playability of the construction toy 10, the front panel 34 includes an aperture or front door 58 at the bottom thereof and a loft entrance aperture 59 directly above the door 58. Additionally, indicia on the panels may provide added realism to the barn 30.

The track sections 14 are shown in FIG. 4 and in end view in FIG. 7. The track sections each include a generally flat longitudinal plate or base portion 60. A pair of vertical side walls 62 are secured along the length thereof and a pair of intermediate, inwardly spaced vertical walls 64 defining tracks. The track sections 14 are mentioned previously are reversible and can be used on each side as shown in FIG. 4. In the left of FIG. 4, the flat surface 60 is on the top and defines a road surface for conventional toy vehicles such as cars and trucks. The side walls 62 extend slightly above the surface to provide a guiding side rail.

When in the reverse position, as shown in the right of FIG. 4, the track portions define a railroad track for use with suitable train vehicles 70 as shown in perspective in FIG. 2. A plurality of evenly spaced inwardly directed detents or tabs 68 adjacent the inner flanges 64 will engage the wheels of the train, as described in greater detail hereinafter, to provide a clicking or clattering sound as is commonly associated with a train.

Figure 5:
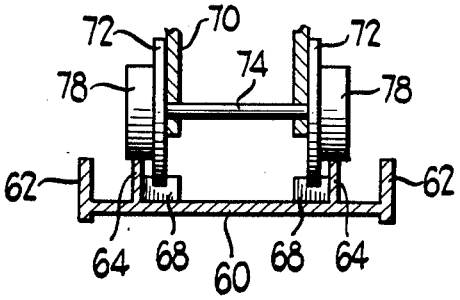
FIG. 5 is a vertical section of one of the track portions showing the wheels of the train vehicle riding thereon.

In particular, referring to the end view of FIG. 5, the train 70 (FIG. 2) includes a plurality of wheels 72, each pair of which are mounted by an axle 74 and spaced thereby to engage the tabs 68 as the train traverses the track sections 14. The wheels 72 will engage and roll over each of the tabs 68 in succession to provide the clicking, train sound. Each of the wheels 72 is provided with a generally enlarged or over-sized hub 78 on the outsides of the wheels for use when traversing the grid 12.

Figure 6:
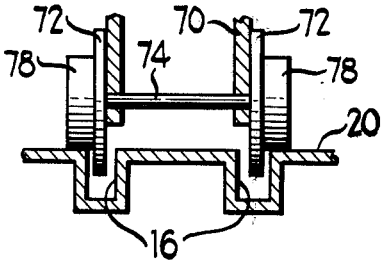
FIG. 6 is a vertical section taken generally along line 6—6 of FIG. 2 showing the wheels of the train vehicle riding thereon.

More particularly, referring to FIG. 6, the hubs 78 of each wheel 72 will engage the surfaces 20 for rollingly supporting the train vehicles 70 thereacross. When traversing the grid 12, the wheels 72 will clear the bottom of each of the grooves 16 so that, as the hubs 78 engage the grooves at 90° to the traversing grooves, the associated clicking sound will continue to be produced. Therefore, whether the train vehicle 70 is traversing either the side of the track shown at the right in FIG. 4 or the grid, the same clicking sound will be heard throughout its travel.

A connecting means, generally designated 82, is provided on the end of each track section for securing the individual track sections together and for securing the track sections to the base 12. More particularly, referring to FIG. 8, each of the connecting means 82 includes a male portion 86 and a complementary female portion 88 for engagement of adjacent pieces. The male portion 86 includes a substantially circular protrusion 90 which extends past the end of the track section and is secured thereto by a pair of integrally molded flanges 92. The female portion 88 is generally crescent-shaped having an internal diameter substantially equal to the outside diameter of the protrusion 90 for encapsulating the same. Each of the circular protrusions 90 includes a tapered slot 93 therein which permits flexing thereof for an accurate, tight fit. The male portions 86 and female portions 88 of the connecting means are positioned adjacent one another as shown in FIGS. 4 and 8 in a similar manner for all of the track sections so that any track section can be interchanged with any other track section.

The vertical slots 24 in the base 12 are designed to be approximately the same width as the terminal portion of each circular protrusion 90 of each male connector 86 so that when inserted thereunder and fit therein, the male connector 86 will maintain the track in a position against the base. Note that as described and shown, the male portions 86 of the connecting means 82 are offset to one side. When assembling the track portions 14 for use with the train 70 as shown in the bottom left portion of FIG. 1, each track section 14 will be aligned so that the wheels 72 of the train 70 will pass from the track directly into the grooves 16 on the grid. However, when flipped over for use with conventional toy trucks or cars, the track sections 14 are actually shifted relative to the grid so that the end flanges 62 substantially align with the grooves 16 in the grid so that the vehicle wheels will not be guided into the grooves 16. In either case, when used as a track or a road surface, the track sections 14 are retained in engagement with the grid base 12 by the single male connector portion 86 within the slots 24.

The foregoing detailed description has been given for clearness of understanding only and no unnecessary limitations should be understood therefrom as some modifications will be obvious to those skilled in the art.

We claim:

1. A reversible track, and a toy vehicle having flanged wheels comprising, in combination:

at least one elongated reversible track section, said track section having a wide groove defined by a flat surface and a pair of vertical side flanges extending longitudinally along one side thereof and guide means extending longitudinally along the other side thereof, said guide means including a pair of spaced, longitudinally extending flanges mounted inwardly of the sides of the track section for engagement with the wheels of said vehicle to direct same therealong and a plurality of longitudinally spaced detents along said inwardly mounted flanges for engaging the flanges of the wheels of the toy vehicle for producing a repetitive audible sound as the toy vehicle moves along the track section; and a toy vehicle including a pair of flanged wheels laterally spaced apart by an axle for engagement and support by the guide means on said other side of the track section and for free movement across said flat side of the track section.

2. The reversible track and vehicle combination of claim 1 wherein said detents comprise a plurality of spaced tabs connected to said inwardly mounted flanges and protruding upwardly in a plane generally normal to said flat surface.

3. The reversible track and vehicle combination of claim 2 wherein said spaced tabs protrude vertically to a predetermined distance less than said inwardly mounted flanges so as to engage only the flanged portions of said toy vehicle wheels.

4. The reversible track and vehicle combination of claim 1 including connecting means for connecting one or more of said reversible track sections, said connecting means including means for maintaining proper alignment between adjacent track sections with respect to one side of said reversible track.

5. A reversible track section for wheeled toy vehicles, comprising:

a plurality of elongated reversible track sections, each track section having a wide groove on one side thereof defined by a flat surface and a pair of vertical side flanges extending longitudinally along the sides thereof and guide means on the other side thereof, said guide means including a pair of generally vertically protruding longitudinally extending flanges mounted on a second flat surface inwardly of the sides of the track section for directing a wheeled vehicle therealong and detent means comprising a plurality of spaced tabs connected to said inwardly mounted flanges and each protruding upwardly in a plane generally normal to said second flat surface for engagement with the wheels of a toy vehicle for producing a rhythmic repeating, audible signal as the wheeled vehicle is moved along the guide means.

* * * * *